United States Patent [19]

Kim

[11] Patent Number: 4,766,611

[45] Date of Patent: Aug. 30, 1988

[54] GLOVE AND WATCH

[76] Inventor: Young S. Kim, 22573 Woodridge Ct., Cupertino, Calif. 95014

[21] Appl. No.: 80,329

[22] Filed: Jul. 31, 1987

[51] Int. Cl.[4] ..... A41D 19/00

[52] U.S. Cl. ..... 2/160; 2/161 A

[58] Field of Search ..... 2/160, 161 A, 158, 159

[56] References Cited

U.S. PATENT DOCUMENTS

| | | | |
|---|---|---|---|
| 1,309,150 | 7/1919 | Monfort | 2/160 X |
| 1,374,257 | 4/1921 | Raalte | 2/160 |
| 2,103,711 | 12/1937 | Cole | 2/160 |
| 4,040,126 | 8/1977 | Cecil | 2/161 A |
| 4,244,057 | 1/1981 | Burnham | 2/160 |
| 4,387,838 | 6/1983 | Jackson | 2/160 X |
| 4,489,444 | 12/1984 | Graham | 2/160 |
| 4,536,889 | 8/1985 | Taylor et al. | 2/160 |

*Primary Examiner*—Werner H. Schroeder

*Assistant Examiner*—J. L. Olds

*Attorney, Agent, or Firm*—Flehr, Hohbach, Test, Albritton & Herbert

[57] ABSTRACT

A golf glove (70) and watch (72) combination (74) uses a conventional golf glove (70) without modification. Strap (76) of the watch (72) feeds through retaining slots (78) on watch cases (80) and has Velcro hooks (82) on its surface facing away from the watch case (80). The strap (76) extends partly around flap (84) of the glove (70), so that ends (86) of the strap (76) engage Velcro loops (87) on the underside of the flap (84). The golf glove (70) has a pad (88) of Velcro hooks (90) beneath the flap (84) for mating engagement of the Velcro loops (87) on the underside of the flap (84). When the flap (84) is pressed against the pad (88) so that the Velcro loops (87) and hooks (90) engage with ends (86) of the strap (76) in place, the watch (72) is held securely in place.

10 Claims, 5 Drawing Sheets

GLOVE AND WATCH

BACKGROUND OF THE INVENTION

1. Field of the Invention

This invention relates to a glove incorporating a timepiece. More particularly, it relates to a golf glove having a watch attached to the glove. Most especially, it relates to such a golf glove and watch in which the watch is securely fastened to the glove, yet easily removable for replacement of the glove.

2. Description of the Prior Art

Because of the stresses on a wrist watch when a golfer hits a golf ball and the distraction of the watch moving on the user's wrist during a golf swing, golfers usually take their watches off while playing golf. For a serious golfer, the presence of a watch on the wrist is even a distraction while putting. If the golfer wants to keep track of the time of day while playing, he or she must find the watch in his or her golf bag or pocket, which is inconvenient. A need therefore exists for an improved way of keeping a watch convenient for a golfer while playing.

It is also often inconvenient for a wearer of a wrist watch to see the time when clothed for very cold weather, either in normal daily activity in winter or for winter sports, such as skiing.

SUMMARY OF THE INVENTION

Accordingly, it is an object of this invention to provide a structure allowing a golfer to wear a watch on his or her wrist without having the watch interfere with the golfer's swing.

It is another object of the invention to provide such a structure in the form of a watch attached to a glove in which the watch is securely fastened to the glove, yet is readily removable for use with another glove.

It is a further object of the invention to provide an improved form of a package incorporating a watch integrally into a glove.

The attainment of these and related objects may be achieved through use of the novel glove and watch combination herein disclosed. A glove and watch combination in accordance with this invention has a glove having a flap joined by a first end to the glove. The flap has a second end and a means for attaching the second end of the flap to the glove. A timepiece has a means for attaching the timepiece to the flap. This combination provides the timepiece in a position where it is readily available to a person wearing the glove, without interfering with activities being carried out by the person, such as playing golf.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
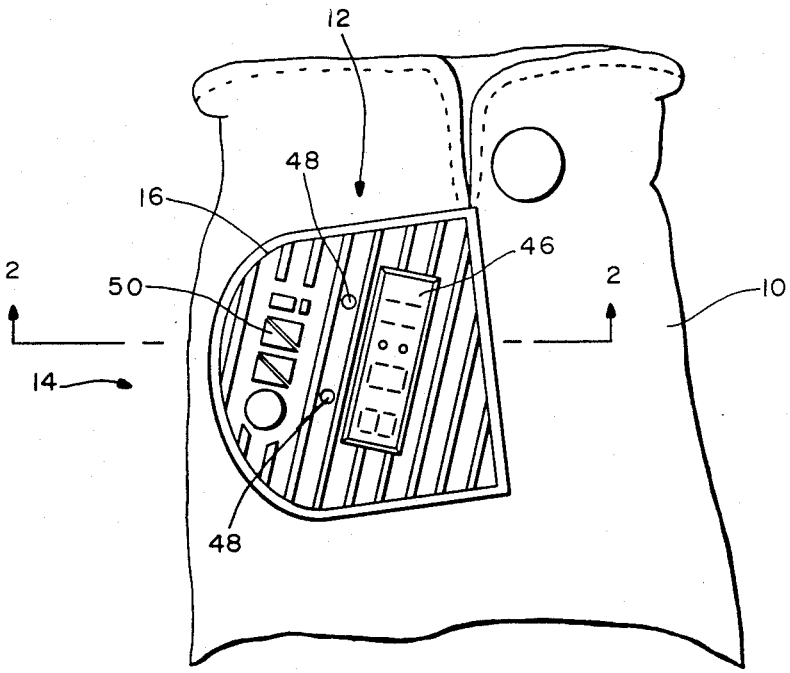
FIG. 1 is a plan view of a portion of a glove and watch combination in accordance with the invention.
Figure 2:
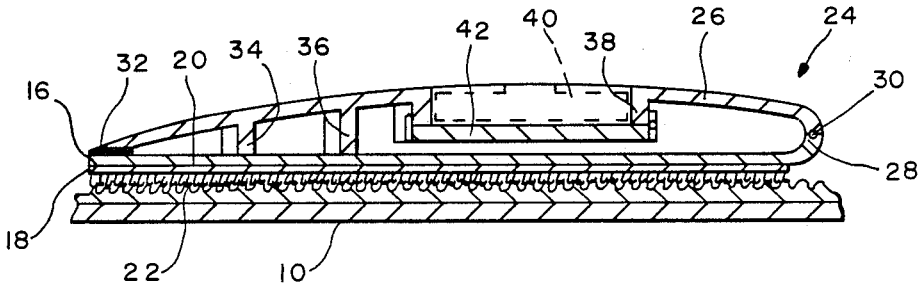
FIG. 2 is a cross-section view, taken along the line 2—2 in FIG. 1.
Figure 3:
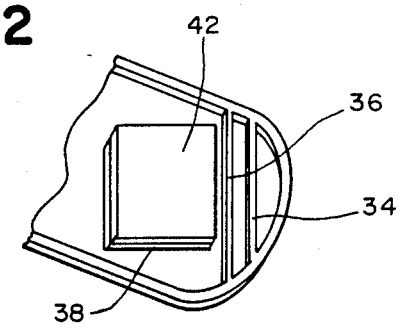
FIG. 3 is a bottom and perspective view of a portion of the glove and watch combination of FIGS. 1 and 2.

Turning now to the drawings, more particularly to FIGS. 1–3, there is shown a golf glove 10 and digital watch 12 combination 14 in accordance with the invention. The golf glove 10, except for the watch 12 and its associated structure for incorporating it into the golf glove, is of conventional construction. A flap 16 on the glove 10 has a layer 18 of Velcro loop fabric on underside 20 of the flap 16. A mating layer 22 of Velcro hooks is provided on the glove 10 beneath the flap 16. The two mating Velcro layers 18 and 22 serve to fasten the glove 10 around a user's wrist.

The watch 12 is built into the flap 16. A rigid plastic housing 24 forms a top of the flap 16 and has upper and lower molded halves 26 and 28 joined together at 30 and 32. Vertical ribs 34 and 36 extend between the upper and lower halves to impart structural rigidity to the plastic housing 24.

Receptacle 38 for electronics 40 of the watch 12 is built into the upper half 26 of the plastic housing, as shown in FIGS. 2 and 3. A cover 42, hinged to the receptacle 38 at 44, allows access to the interior of the receptacle 38 for insertion and removal of the watch electronics 40.

The watch 12 has a conventional digital display 46 facing upward in the housing 24. Buttons 48 are used to control operation of the watch. If desired, a logo 50 or other design can be molded into the upper half 26 of the housing 24.

The combination 14 provides a golfer with convenient access to a watch 12 in his or her golf glove 10 without distracting the golfer by moving on his or her wrist during a golf swing or impact of a golf club on a golf ball. The construction of the combination 14 allows the watch 12 to be provided integrally as part of the golf glove 10 in a low cost package.

Figure 4:
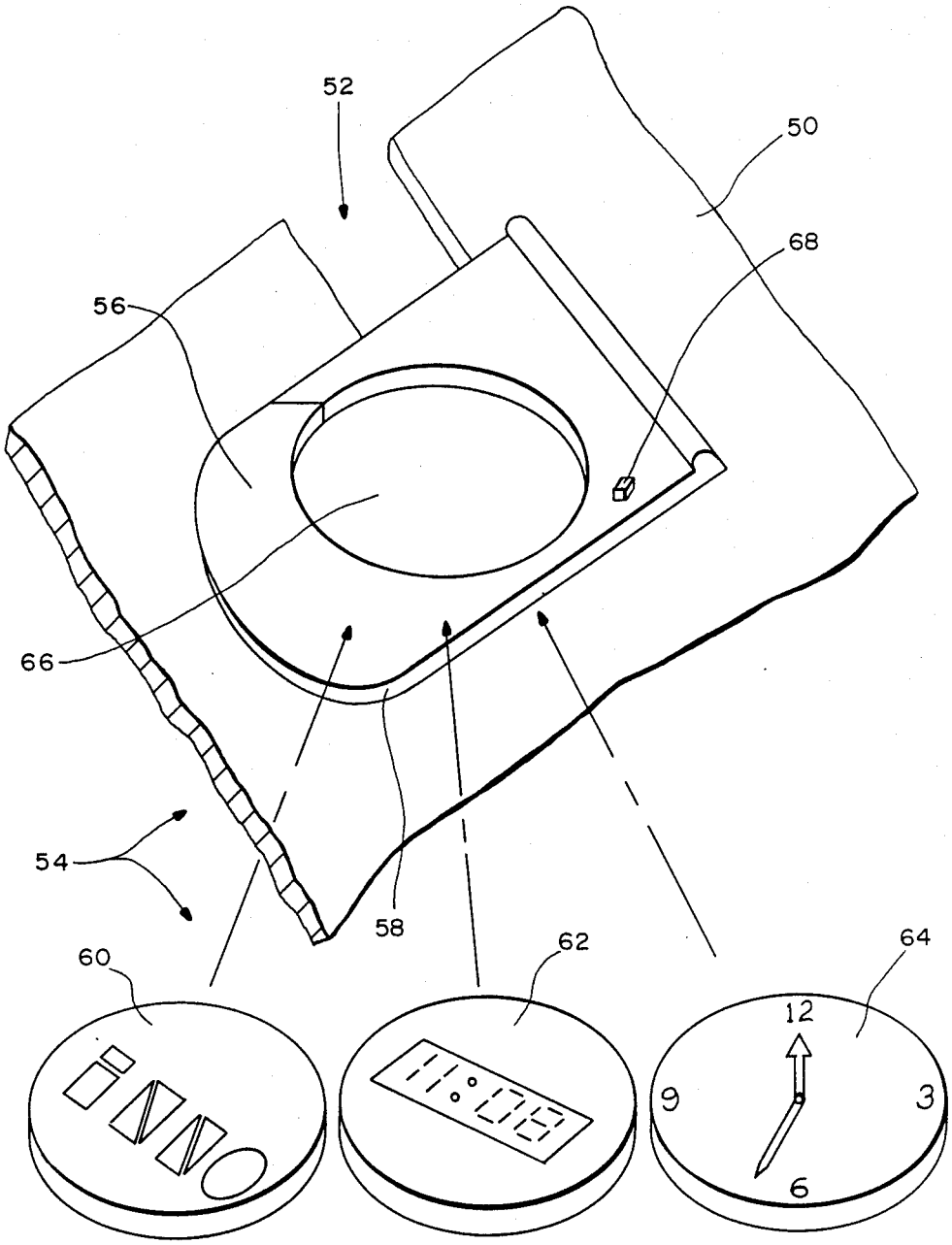
FIG. 4 is a schematic and perspective representation of a second embodiment of a glove and watch combination in accordance with the invention.

FIG. 4 shows another form of a golf glove and watch 52 combination 54. In the combination 54, a receptacle 56 is mounted on flap 58 of the glove 50 for receiving different modules 60, 62 and 64 in cavity 66 of the receptacle 56. Push button 68 is activated to allow insertion and removal of the modules 60–64 into and from the cavity 66.

In practice, the golf glove 50 can be sold with the logo module 60 in place in the cavity 66. The purchaser can then select the digital watch module 62 or the analog watch module 64 for insertion in the cavity 66.

Since golf gloves must be replaced often in use, the watch modules 62 and 64 will have a much longer useful lifetime than the golf glove 50. The modules 62 and 64 can therefore be removed from the golf glove 50 and inserted in a corresponding cavity 66 of a receptacle 56 in a new golf glove 56. Other than as shown and described, the construction and operation of the FIG. 4 embodiment of the invention is the same as the FIGS. 1–3 embodiment.

Figure 5:
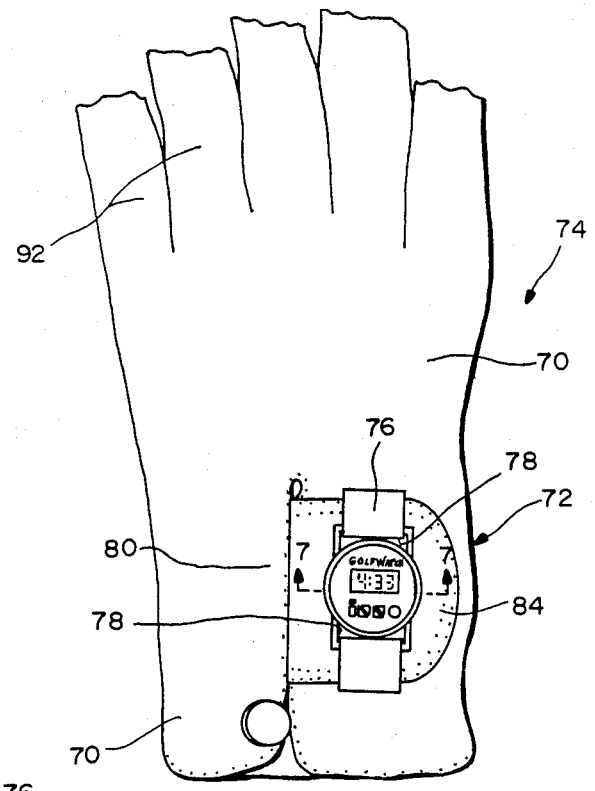
FIG. 5 is a plan view of a third embodiment of a glove and watch combination in accordance with the invention.
Figure 6:
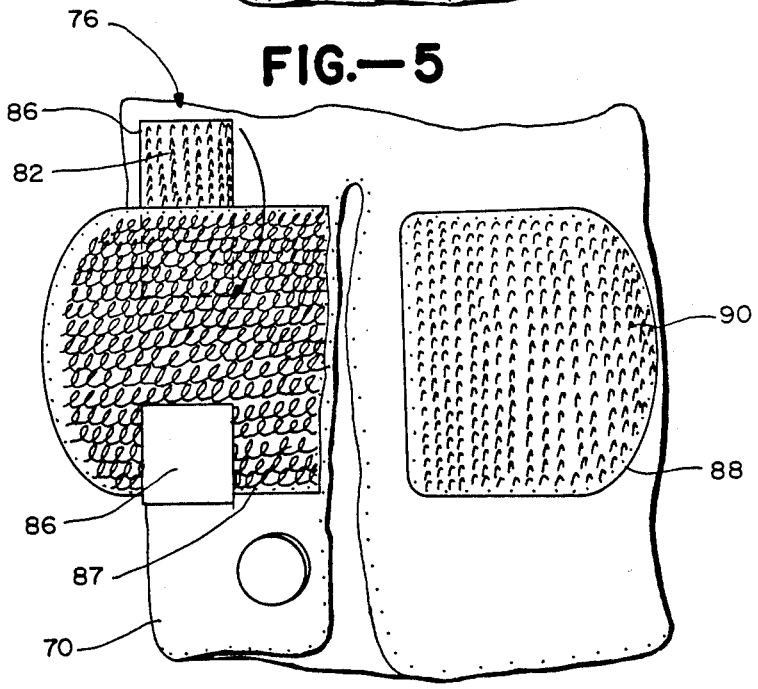
FIG. 6 is a enlarged plan view of a portion of the glove and watch combination of FIG. 5.
Figure 7:
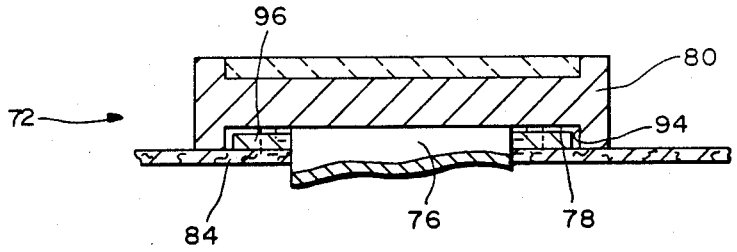
FIG. 7 is a cross-section view, taken along the line 7—7 in FIG. 5.

FIGS. 5–7 show a third form of a golf glove 70 and watch 72 combination 74 that uses a conventional golf glove 70 without modification. Strap 76 of the watch 72 feeds through retaining slots 78 on watch case 80 and has Velcro hooks 82 (FIG. 6) on its surface facing away from the watch case 80. The strap 76 extends partly around flap 84 of the glove 70, so that ends of the strap 76 engage Velcro loops 87 on the underside of the flap 84, best shown in FIG. 6. The golf glove 70 has a pad 88 of Velcro hooks 90 beneath the flap 84 for mating engagement of the Velcro loops 87 on the underside of the flap 84. When the flap 84 is pressed against the pad 88 so that the Velcro loops 87 and hooks 90 engage with ends 86 of the strap 76 in place, the watch 72 is held securely in place. As shown, the watch 72 is preferably mounted on the flap 84 with the digital display oriented away from fingers 92 of the glove 70 for easier reading of the watch 72 by a golfer wearing the glove 70. As is best shown in FIG. 7, case 80 of the watch 72 has a recess 94 in its back surface which is configured to receive a logo patch 96 of the type conventionally employed on the fastening flap 84 of most golf gloves. These logo patches typically have a diameter of 1¼ inch. This construction reduces the extent the watch 72 extends above the flap 84 when it is in place.

Figure 8:
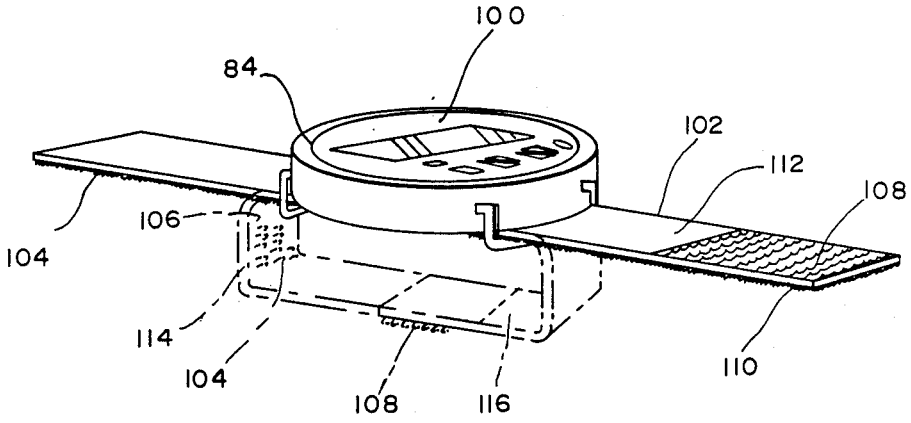
FIG. 8 is a perspective view of a portion of a fourth embodiment of a glove and watch combination in accordance with the invention.

FIG. 8 shows a fourth form of a watch 100 with a different form of a strap 102 designed for attaching the watch 100 to flap 84 of the golf glove. The strap 102 has Velcro hooks 104 on its surface 106 facing away from the watch 100 and Velcro loops 108 at one end 110 of its surface 112. With this form of the strap 102, the Velcro hooks 104 on ends 114 and 116 of the strap 102 engage mating Velcro loops (not shown) on the underside of the flap 84 when the strap 102 is wrapped around the flap 84. Unlike the FIGS. 5–7 embodiment, the ends 114 and 116 of the strap 102 cover a significant portion of the underside of the flap 84. However, the Velcro loops 108 face downward with the strap 102 wrapped around the flap 84 so that they engage mating Velcro hooks on the golf glove beneath the flap 84. This structure provides a secure attachment of the flap 84, strap 102 and the golf glove together. Other than as shown and described, the construction and operation of the FIG. 8 embodiment of the invention is the same as that of the FIGS. 5–7 embodiment.

Figure 9:
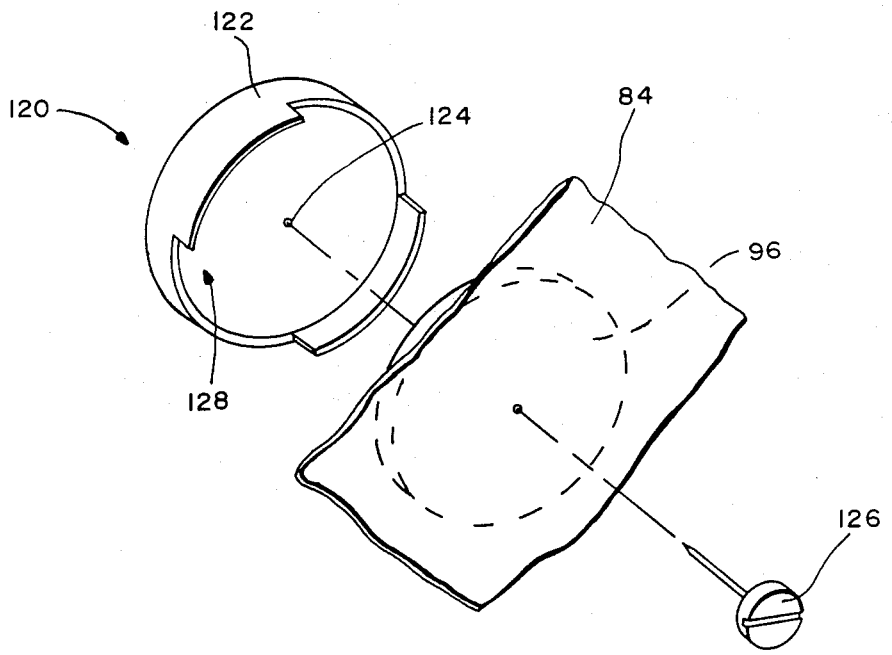
FIG. 9 is a perspective view of a portion of a fifth embodiment of a glove and watch combination in accordance with the invention.

FIG. 9 shows a watch 120 that has its case 122 modified to include a threaded fitting 124 into which a stud 126 is screwed to fasten the watch 120 to flap 84 of the golf glove. The stud 126 passes from the underside of the flap 84 through the flap 84 and the logo patch 96 to enter the threaded fitting 124. The logo patch 96 fits into recess 128 on the back of the the case 122 in the same manner as in the FIGS. 5–7 embodiment. This same approach could be carried out with a pin and a friction fit aperture for the pin as well.

Figure 10:
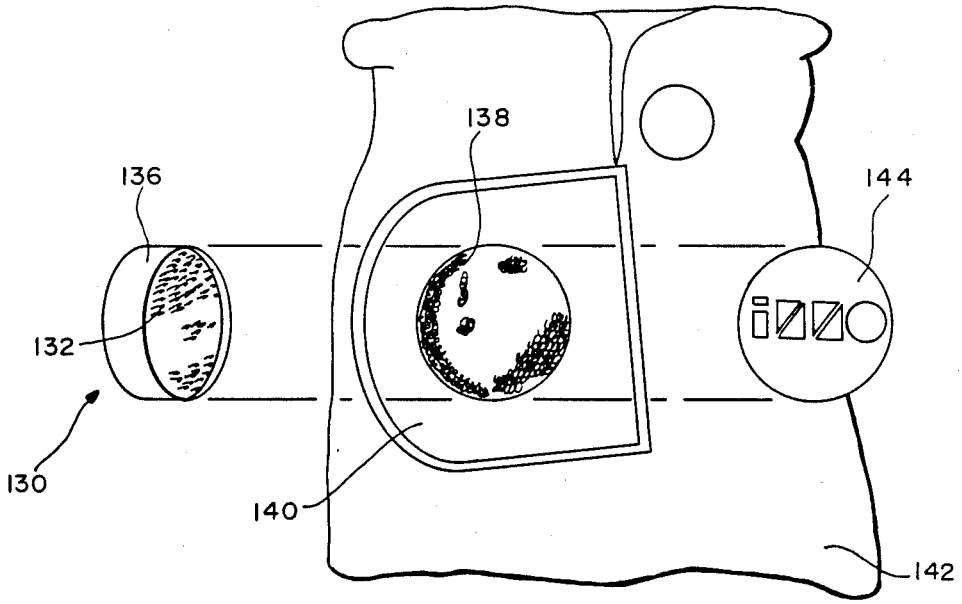
FIG. 10 is a partially exploded perspective view of a sixth embodiment of a glove and watch combination in accordance with the invention.

FIG. 10 shows a watch 130 that has a layer 132 of Velcro loops on the bottom of case 136. A mating patch 138 of Velcro hooks on the upper surface of flap 140 of golf glove 142 engages the Velcro loops 132 to hold the watch 130 on the flap 140. Logo patch 144 has Velcro loops on its bottom, and is used to cover the Velcro hooks 138 when they are not being used to attach the watch 130 to the golf glove 142. If desired, the glove 142 can be marketed separately with the logo patch 144 in place, so that the purchaser can make his or her own choice of a watch 130 for use with the glove 142, including transfer of a watch 130 from a glove 142 that is being discarded to a new glove 142, as in the FIG. 4 embodiment.

It should now be readily apparent to those skilled in the art that a novel glove and watch combination capable of carrying out the stated objects of the invention has been provided. The watch is securely fastened to the glove in the combination, so that it is readily available to a wearer of the glove without interfering with other activities of the wearer. In the case of a golf glove, the watch is readily available without interfering with the golfer's play and without moving on a user's wrist during a golf swing.

It should further be apparent to those skilled in the art that various changes in form and details of the invention as shown and described may be made. For example, the positions of the Velcro hooks and loops in any of the embodiments including them could be interchanged. It is intended that such changes be included within the spirit and scope of the claims appended hereto.

What is claimed is:

1. In combination, a glove, a timepiece, and means for attaching said timepiece to said glove, said glove having a flap joined by a first end to said glove, said flap having a second end, said combination including a means for attaching the second end of said flap to said glove, and said means for attaching said timepiece to said glove being configured to attach said timepiece to an upper surface of said flap so as to be visible when the second end of the flap is attached to said glove.

2. The combination of claim 1 in which said means for attaching the second end of said flap to said glove comprises first and second mating fabric hook and loop fabric strips on a surface of said flap facing said glove and on said glove beneath said flap.

3. In combination, a glove, a timepiece, and means for attaching said timepiece to said glove, said glove having flap joined by a first end to said glove, said flap having a second end, said combination including a means for attaching the second end of said flap to said glove, and said means for attaching said timepiece to said glove being configured to attach said timepiece to said flap so as to be visible when the second end of the flap is attached to said glove, said means for attaching the second end of said flap to said glove comprising first and second mating fabric hook and loop fabric strips on a surface of said flap facing said glove and on said glove beneath said flap, said means for attaching said timepiece to said glove comprising a third mating fabric strip having a first surface attachable to the first mating fabric strip on the surface of said flap facing said glove, said timepiece having a case, said third mating fabric strip being attached to the case of said timepiece.

4. The combination of claim 3 in which said first mating fabric strip on the surface of said flap facing said glove comprises a fabric loop strip and the surface of said third mating fabric strip attachable to the first mating fabric loop strip comprises a fabric hook surface.

5. The combination of claim 3 in which said third mating fabric strip additionally has a second surface attachable to said second mating fabric strip on said glove when said timepiece is attached to said flap with said third mating fabric strip.

6. The combination of claim 5 in which the second surface of said third mating fabric strip comprises a fabric loop surface and said second mating fabric strip comprises a fabric hook strip.

7. The combination of claim 2 in which means for attaching said timepiece to said glove comprises a molded plastic case forming an upper surface of said flap.

8. The combination of claim 7 in which said molded plastic case includes a receptacle for electronics of said timepiece, said receptacle having an end facing into an interior of said molded plastic case, the end having a removable cover over the end.

9. In combination, a glove, a timepiece, and means for attaching said timepiece to said glove, said glove having a flap joined by a first end to said glove, said flap having a second end, said combination including a means for attaching the second end of said flap to said glove, and said means for attaching said timepiece to said glove being configured to attach said timepiece to said flap so as to be visible when the second end of the flap is attached to said glove, said means for attaching said timepiece to said glove comprising an elongated member passing through said flap.

10. In combination, a glove, a timepiece, and means for attaching said timepiece to said glove, said glove having a flap joined by a first end to said glove, said flap having a second end, said combination including a means for attaching the second end of said flap to said glove, and said means for attaching said timepiece to said glove being configured to attach said timepiece to said flap so as to be visible when the second end of the flap is attached to said glove, said means for attaching said timepiece to said glove comprising mating fabric hook and loop members on a back of a housing of said timepiece and said flap.

* * * * *